US006343722B1

(12) United States Patent
Di Giovanni

(10) Patent No.: US 6,343,722 B1
(45) Date of Patent: Feb. 5, 2002

(54) ELEMENT FOR FIXING A DISPENSING MEMBER ON A CONTAINER NECK, DISPENSING DEVICE COMPRISING SAME AND FIXING METHOD

(75) Inventor: Patrick Di Giovanni, La Londe (FR)

(73) Assignee: Valois S.A., Neubourg (FR)

( * ) Notice: Subject to any disclaimer, the term of this patent is extended or adjusted under 35 U.S.C. 154(b) by 0 days.

(21) Appl. No.: 09/622,814

(22) PCT Filed: Feb. 24, 1999

(86) PCT No.: PCT/FR99/00408

§ 371 Date: Nov. 20, 2000

§ 102(e) Date: Nov. 20, 2000

(87) PCT Pub. No.: WO99/43575

PCT Pub. Date: Sep. 2, 1999

(30) Foreign Application Priority Data

Feb. 24, 1998 (FR) ..... 98/02214

(51) Int. Cl.[7] ..... B65D 83/14

(52) U.S. Cl. ..... 222/402.1; 222/394; 277/316; 277/630; 277/637

(58) Field of Search ..... 222/402.1, 402.24, 222/402.25, 394; 277/630, 637, 644, 316; 413/9

(56) References Cited

U.S. PATENT DOCUMENTS 3,045,877 A * 7/1962 Green ..... 222/402.24
4,045,860 A * 9/1977 Winckler ..... 413/9
4,111,339 A * 9/1978 Schmidt ..... 222/394
4,621,964 A * 11/1986 Radtke et al. ..... 413/9
5,199,615 A * 4/1993 Downing et al. ..... 222/402.1

FOREIGN PATENT DOCUMENTS

| | | |
|---|---|---|
| FR | 2 738 557 | 3/1997 |
| GB | 843371 | 6/1960 |
| WO | WO94/16970 | 8/1994 |

* cited by examiner

*Primary Examiner*—Kevin Shaver
*Assistant Examiner*—Patrick Buechner
(74) *Attorney, Agent, or Firm*—Sughrue Mion, PLLC

(57) ABSTRACT

A fixing element (10) for fixing a dispenser member (20), such as a pump or a valve, to the neck (31) of a container (30) containing a substance to be dispensed, with a neck gasket (1) being interposed, the neck gasket having an inner edge (2) and an outer edge (3) for providing sealing at the neck (31) of the container (30), the fixing element (10) including a dispenser member receiving portion (11) for receiving the dispenser member (20) and a fixing portion (12) for fixing to the neck (31) of the container (30), the fixing element (10) being characterized in that it further includes a holding portion (13) for receiving and holding the neck gasket (1), the annular gasket (1) being held in the holding portion (13) of the fixing element (10) at its inner edge (2) only.

14 Claims, 2 Drawing Sheets

ELEMENT FOR FIXING A DISPENSING MEMBER ON A CONTAINER NECK, DISPENSING DEVICE COMPRISING SAME AND FIXING METHOD

The present invention relates to: a fixing element for fixing a dispenser element to the neck of a container; a dispenser device including such a fixing element; and a method of fixing a dispenser member by means of such a fixing element. More particularly, the present invention relates to a crimpable cap for fixing a metering valve to the neck of a container, with a neck gasket being interposed for providing sealing at the neck of the container.

TECHNICAL FIELD

It is common to use a fixing element to fix a pump or a valve to the neck of a container. A typical fixing element generally includes a dispenser member receiving portion for receiving the dispenser member securely, and an "intermediate" portion which, after putting the fixing element in place, positions the neck gasket on the top edge of the neck of the container so as to guarantee leaktightness. Such typical fixing elements, which may be screw-on or snap-fastenable rings, or crimpable caps, suffer from drawbacks:

BACKGROUND

In a dispenser of substance containing a propellant gas, such as, in particular, a gas of the hydrofluoroalkane (HFA) propellant gas type, an interaction or a reaction can take place between the gasket and the active substance. In order to avoid or minimize that drawback, it has been proposed to make a neck gasket of small surface area. Such a neck gasket is then positioned in a ring which is fitted around the body of the valve serving to dispense the substance, as disclosed, for example, in Document FR-2 738 557. The presence of that ring increases the cost of manufacturing and complicates assembly. In addition, the risk of interaction or reaction between the material of the ring and the active substance also exists.

Documents EP-0 101 157 and WO 94/16970 disclose a fixing cap for an aerosol container and provided with an annular recess serving to receive the neck gasket. The dimensions of said recess are substantially identical to the dimensions of the neck gasket, said gasket being inserted into said recess under force, so that it is already pre-stressed prior to mounting the cap on the neck of the container. In addition, the gasket must have very accurate dimensions so as to fit into said recess, so that no manufacturing tolerance is acceptable for the gasket, and it is thus necessary to use gasket-manufacturing methods that are very expensive, such as molding or overmolding. Similarly, the recesss in the fixing cap must also be made with high dimensional accuracy, which complicates its manufacture and thus increases its cost.

SUMMARY OF THE INVENTION

An object of the present invention is to provide a fixing element that does not reproduce the above-mentioned drawbacks.

A particular object of the present invention is to provide a fixing element that is simple and low-cost to make.

Another object of the present invention is to provide such a fixing element that makes it possible to use a neck gasket of small surface area while also omitting the ring for positioning the gasket.

Another object of the present invention is to provide such a fixing element that makes it possible to manufacture neck gaskets using simple means, and at low cost, and that makes it possible to have manufacturing tolerances that are relatively high.

Yet another object of the present invention is to provide a fixing element that enables neck gaskets to be made using any desired manufacturing methods, and with any desired suitable materials.

A further object of the present invention is to provide a dispenser device for dispensing a fluid substance, which device can be made and assembled at low cost, while guaranteeing excellent leaktightness, even when propellant gases such as HFA gases are used.

An additional object of the present invention is to provide a method of assembling a dispenser device for dispensing a fluid substance, in which method assembly is facilitated and is thus lower in cost.

The present invention thus provides a fixing element for fixing a dispenser member, such as a pump or a valve, to the neck of a container containing a substance to be dispensed, with a neck gasket being interposed, the neck gasket having an inner edge and an outer edge for providing sealing at the neck of the container, said fixing element including a dispenser member receiving portion for receiving said dispenser member and a fixing portion for fixing to said neck of the container, said fixing element further including a holding portion for receiving and holding said neck gasket, said annular gasket being held in said holding portion of the fixing element at its inner edge only.

Advantageously, the holding portion of the fixing element is provided with an annular recess made up of an end wall, of an outer side wall, and of an inner side wall, said inner side wall being provided with retaining means for co-operating with said inner edge of the neck gasket to hold it securely inside said recess.

Advantageously, said inner side wall of the annular recess forms an angle of less than 90° relative to said end wall, so that the diameter of said inner side wall varies relative to the center axis of the fixing element, with, at its end opposite form said end wall, a diameter greater than the diameter of the inner edge of said gasket.

Preferably, the difference in diameter between the ends of said inner side wall is such that, once in place in the recess, the gasket is not pre-stressed.

Advantageously, said neck gasket is inserted into said recess prior to mounting said fixing element.

Advantageously, said fixing portion is provided with crimping, snap-fastening, or screw-fastening means.

The present invention also provides a device for dispensing a fluid substance, the device including a dispenser member, such as a pump or a valve, mounted on the neck of a container containing a substance to be dispensed, with a neck gasket being interposed to provided sealing at said neck of the container, said dispenser member being mounted on said neck by means of a fixing element as defined above.

Preferably, the dispenser member is a metering valve and the fixing member is a cap, that is preferably made of metal, and that is fixed to the neck by crimping.

The present invention also provides a method of fixing a dispenser member, such as a pump or a valve, to the neck of a container containing a substance to be dispensed, with a neck gasket being interposed to provide sealing at said neck of the container, said method comprising the following steps:

providing a fixing element including a dispenser member receiving portion for fixing to said dispenser member, a fixing portion for fixing to said neck of the container, and a holding portion for receiving said neck gasket and holding it securely;

mounting the dispenser member in said dispenser member receiving portion of the fixing element;

disposing said neck gasket in said holding portion of the fixing element so as to form a fixing element and gasket unit; and fixing said fixing element and gasket unit to the neck of the container by means of said fixing portion of the fixing element.

Preferably, said step of mounting the dispenser member in the dispenser member receiving portion may, in a variant, be performed after said step of disposing the neck gasket in said holding portion and/or after said step of fixing the fixing element and gasket unit to the container.

Advantageously, said dispenser member is a metering valve, said fixing element is a cap that is preferably made of metal, and said steps of mounting and of fixing are performed by crimping.

Other characteristics and advantages of the present invention will appear on reading the following description of a particular embodiment of the invention given by way of non-limiting example, and with reference to the accompanying drawings, in which:

DETAILED DESCRIPTION

Figure 1:
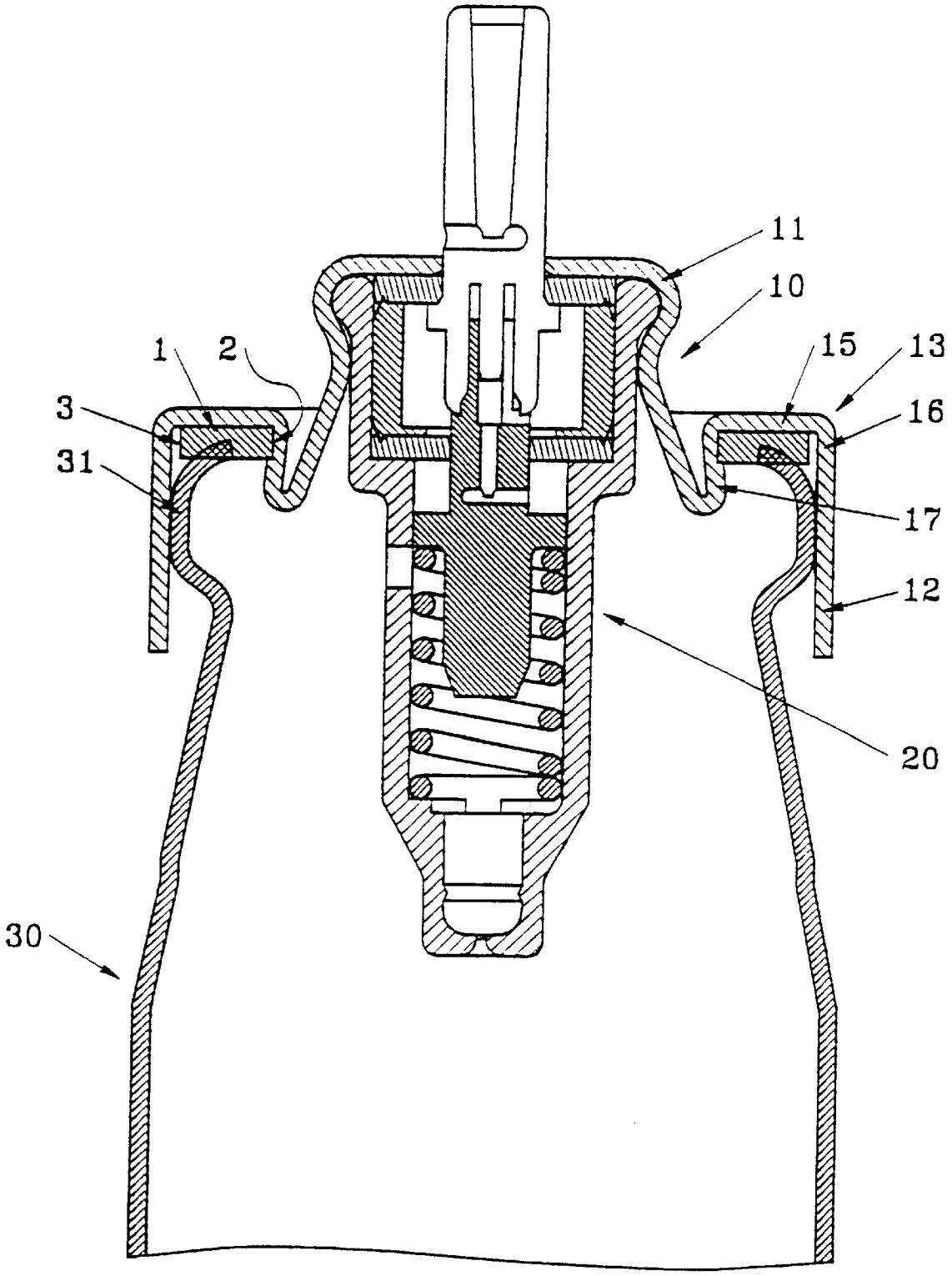
FIG. 1 is a diagrammatic section view of a device for dispensing a fluid substance in an advantageous embodiment of the invention.

The following description is given with reference to a fixing cap for fixing a metering valve to the neck of a container containing a substance and a propellant gas, in particular an HFA propellant gas, but naturally, the present invention is applicable to all types of fixing element (rings or caps) for fixing any dispenser member (pump, metering valve, or non-metering valve) to the neck of a container containing any fluid substance (liquid, powder, or semi-liquid), with or without a propellant gas.

With reference to the figures, the dispenser device includes a dispenser member, such as a metering valve 20, which is mounted on the neck 31 of a container 30 by means of a fixing element 10, in particular a crimpable cap. The metering valve 20 may be of any type, and is therefore not described in any further detail below. It is fixed in a valve-receiving portion 11 of the cap 10, which portion receives the valve body and holds it securely, in particular by snap-fastening or crimping. The cap 10 also includes a fixing portion 12 for fixing it to said neck 31 of the container 30, it being possible for said fixing portion 12 to be provided with crimping, snap-fastening, or screw-fastening means, or with any other known means. In the example shown in the figures, they are crimping means.

In the invention, the fixing element 10 further includes a holding portion 13 which serves to receive a neck gasket 1 and to hold it securely, which neck gasket is placed between the fixing element 10 and the neck 31 of the container so as to providing sealing therebetween. Said holding portion 13 is made such that the neck gasket 1, which is preferably annular and which has an inner edge 2 and an outer edge 3, is held securely in said holding portion 13 at its inner edge 2 only. In the embodiment shown in the figures, said holding portion 13 is provided with an annular recess 14 serving to receive said gasket 1, said annular recesss 14 being constituted by an end wall 15, by an outer annular side wall 16 and by an inner annular side wall 17. In the invention, said inner side wall 17 is provided with retaining means which are organized to co-operate with said inner edge 2 of the neck gasket 1 so as to hold it securely inside said recess 14.

Thus, the present invention provides a fixing element, in particular a crimpable cap, in which the neck gasket 1 can be mounted before the cap is finally mounted on the neck 31 of the container. Preferably, the means for retaining the inner side wall 17 are formed by deforming said inner wall 17, so that said inner side wall forms an angle of less than 90° relative to said end wall 15. Thus, the diameter of said inner side wall 17 increases progressively from a minimum diameter at said end wall 15 to a maximum diameter at its opposite end. The maximum diameter of the inner side wall is preferably slightly greater than the diameter of the inner edge 2 of the neck gasket 1, so that, after it has been inserted into the recess 14, said gasket 1 is held securely in said recesss by said inner side wall only.

Advantageously, the diameter of the inner side wall 17, at the end wall 15, is equal to or slightly less than the diameter of the inner edge 2 of the gasket, so that, when the gasket is inserted into the recess 14, it is not pre-stressed.

Since the gasket 1 is held in the recess 14 only at its inner edge 2, the end wall 15 and the outer side wall 16 of the recess 14 can have dimensions that vary, so that the fixing element 10 can be made with manufacturing tolerances that are relatively high without influencing the positioning of the gasket 1 in said holding portion 13. This also makes it possible for the gasket 1 to have large manufacturing tolerances, thereby, in particular, making it possible to use gasket-manufacturing methods that are low in cost, such as cutting the gasket out from a strip of suitable material, rather than molding it. Naturally, molded gaskets can also be used with the fixing element of the present invention.

Figure 2:
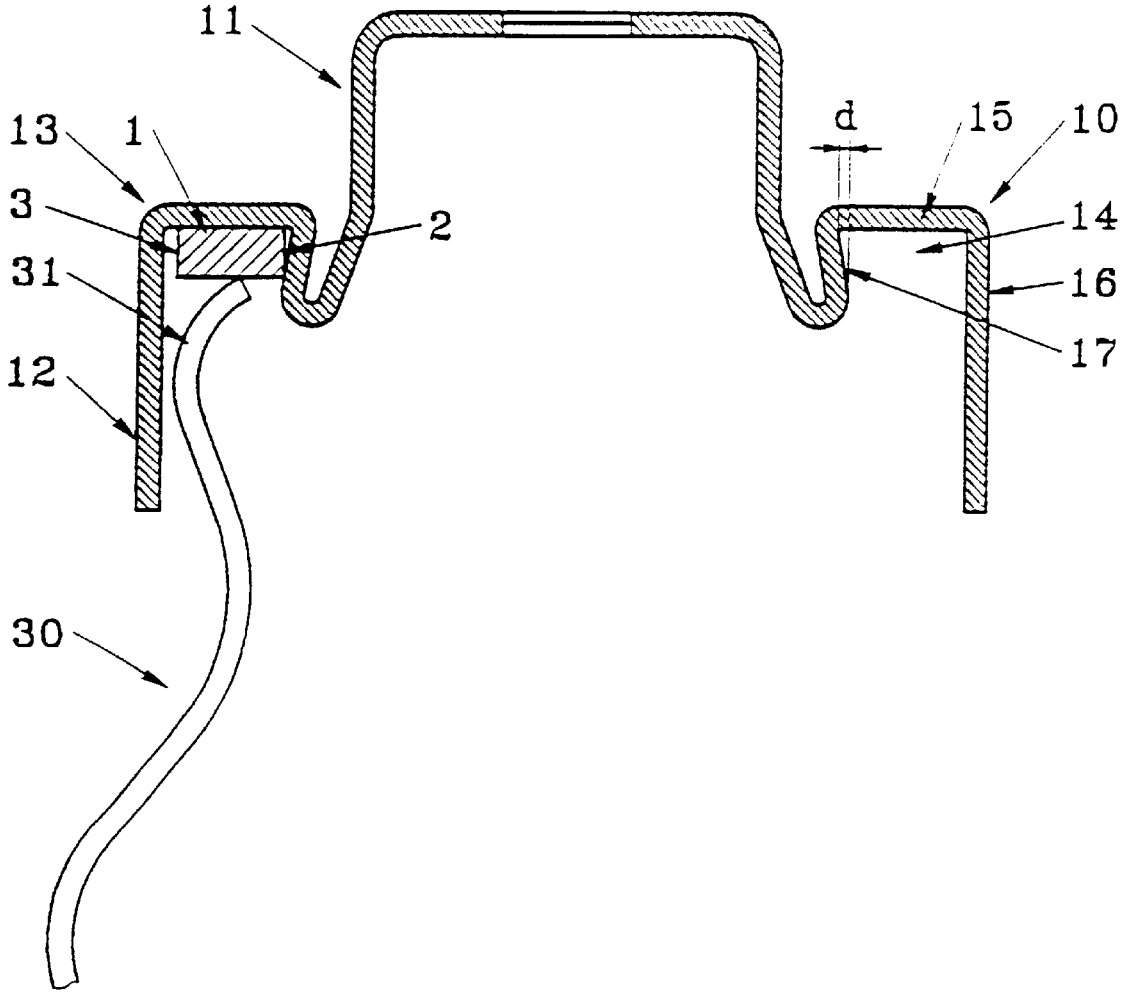
FIG. 2 is a diagrammatic section view showing, more particularly, the fixing element of the advantageous embodiment of the invention.

The fixing element 10 as shown in FIGS. 1 and 2 is particularly simple to manufacture. Thus, when a metal cap is used, such a cap can first be made conventionally with a straight inner wall 17, and then said inner wall can be deformed, e.g. by engaging a cone into the cap. In this way a diameter difference d between the ends of the inner side wall 17 that is relatively large can be obtained, without any major problem arising from any undercut inside the recess 14 due to the slope of the inner side wall 17.

Since the fixing element makes large manufacturing tolerances possible for the neck gasket, said neck gasket can be made by any suitable method from any suitable material, as a function of the subsequent use of the gasket. Thus, the neck gasket may be cut out, molded, or even overmolded, i.e. injected directly into the cap, which makes it possible to use various materials, such as elastomers, in particular nitrile, butyl, or chloroprene, thermoplastic elastomers (TPEs), EPDM, etc. The choice of the manufacturing method and of the material of the gasket naturally depends on the requirements that the gasket is to satisfy, as a function of its use.

An advantage of the invention is that it provides a fixing element that is simple and that can be used in a large number and a wide variety of applications, with sealing requirements that differ widely (device with or without propellant gas, etc.).

Using a fixing element 10 of the invention also makes it possible to implement the method of fixing together or assembling the device more simply and thus at lower cost. In the invention, the neck gasket 1 is put in place in the recess 14 in the cap 10 before said cap is fixed to the container, so that a fixing element and gasket unit is formed that is then secured, and in particular crimped, to the neck of the container. Putting the gasket in place in the cap prior to mounting the cap on the container guarantees that the gasket is positioned properly and makes it unnecessary to use an additional part, such as a gasket-positioning ring which is otherwise necessary, in particular when a neck gasket of small surface area is to be used. The dispenser member can be fixed to the dispenser member receiving portion 11 of the fixing element 10 before or after the gasket 1 is put in place in the recess 14 in the fixing element 10, and it is even possible to consider fixing the dispenser member in said dispenser member receiving portion 11 after the fixing element and gasket unit has been put in place on the neck of the container.

The present invention thus makes it possible, using simple and low-cost means, to assemble a dispenser device including a neck gasket of small surface area, thereby minimizing the interactions with the substance contained inside the container, without it being necessary to use an additional part, and making it possible to make the gasket and/or the fixing element with manufacturing tolerances that are relatively high. Deforming the fixing element 10 at the inner side wall 17 also offers an additional advantage in that such deforming makes it possible to limit the unused volume inside the device, thereby guaranteeing better dispensing of all of the substance contained inside the container.

What is claimed is:

1. A fixing element (10) for fixing a dispenser member (20) to a neck (31) of a container (30) containing a substance to be dispensed with a neck gasket (1) being interposed, the neck gasket having an inner edge (2) and an outer edge (3) for providing sealing at the neck (31) of the container (30), said fixing element (10) including a dispenser member receiving portion (11) for receiving said dispenser member (20) and a fixing portion (12) for fixing to said neck (31) of the container (30), said fixing element (10) being characterized in that it further includes a holding portion (13) for receiving and holding said neck gasket (1), said neck gasket (1) being held in said holding portion (13) of the fixing element (10) at its inner edge (2) only;

in which said neck gasket is annular and the holding portion of the fixing element is provided with an annular recess made up of an end wall, of an outer wall, and of an inner side wall, said inner side wall being provided with retaining means for co-operating with said inner edge of the neck gasket to hold it securely inside said annular recess;

in which said inner side wall of the annular recess forms an angle of less than 90° relative to said end wall, so that a diameter of said inner side wall varies relative to a center axis of the fixing element, and the diameter of said inner side wall at an end of said inner side wall furthest from said end wall is greater than a diameter of the inner edge of said neck gasket; and in which a difference between the diameter of said inner side wall at an end of said inner side wall nearest said end wall and the diameter of said inner side wall at the end of said inner side wall furthest from said end wall is such that, once in place in the recess, the gasket is not pre-stressed.

2. A fixing element according to claim 1, in which said neck gasket (1) is inserted into said recess (14) prior to mounting said fixing element (10).

3. A fixing element according to claim 1, in which said fixing portion (12) is provided with crimping, snap-fastening, or screw-fastening means.

4. The fixing element according to claim 1, wherein the dispensing member is one of a pump and a valve.

5. A device for dispensing a fluid or semi-liquid substance, the device including a dispenser member (20) mounted on the neck (31) of a container (30) containing a substance to be dispensed with a neck gasket (1) being interposed to provide sealing at said neck (31) of the container (30), said device being characterized in that the dispenser member (20) is mounted on said neck (31) by means of a fixing element (10) according to claim 1.

6. A device according to claim 5, in which the dispenser member is a metering valve (20) and the fixing member is a cap (10), that is preferably made of metal, and that is fixed to the neck (31) by crimping.

7. The device according to claim 5, wherein the dispensing member is one of a pump and a valve.

8. A method of fixing a dispenser member (20) to the neck (31) of a container (30) containing a substance to be dispensed, with a neck gasket (1) being interposed to provide sealing at said neck (31) of the container, said method being characterized in that it comprises the following steps:

providing a fixing element (10) according to claim 1;

mounting the dispenser member (20) in said dispenser member receiving portion (11) of the fixing element (10);

disposing said neck gasket (1) in said holding portion (13) of the fixing element (10) so as to form a fixing element and gasket unit; and fixing said fixing element and gasket unit to the neck (31) of the container (30) by means of said fixing portion (12) of the fixing element (10).

9. A method according to claim 8, in which said step of mounting the dispenser member (20) in the dispenser member receiving portion (11) may, in a variant, be performed after said step of disposing the neck gasket (1) in said holding portion (13) and/or after said step of fixing the fixing element and gasket unit to the container (30).

10. A method according to claim 8, in which said dispenser member is a metering valve (20), said fixing element is a cap (10) that is made of metal, and said steps of mounting and of fixing are performed by crimping.

11. The method according to claim 8, wherein the dispensing member is one of a pump and a valve.

12. A fixing element for fixing a dispenser member to a neck of a container, comprising:

a dispenser member receiving portion for receiving the dispenser member;

a fixing portion for securing the fixing element to the neck of the container;

an annular holding portion having an annular end wall, an annular inner side wall extending downwardly from the annular end wall, and an annular outer side wall extending downwardly from the annular end wall and opposing the annular inner side wall; and an annular neck gasket having an inner side edge on an inside diameter of the annular neck gasket and an outer edge on an outside diameter of the annular neck gasket;

wherein the annular holding portion receives and holds the annular neck gasket radially and axially at the inner side edge of the annular neck gasket prior to securing the fixing element to the neck of the container;

wherein a diameter of the annular inner side wall increases in a direction away from the annular end wall, so that the annular inner side wall forms an angle less than ninety-degrees with respect to the annular end wall, and the diameter of the annular inner side wall at an end of the annular inner side wall furthest from the end wall is greater than the diameter of the inner side edge of the neck gasket; and wherein a difference between the diameter of the annular inner side wall at an end of the annular inner side wall nearest the end wall and the diameter of the annular inner side wall at the end of the annular inner side wall furthest from the end wall is such that, once in place in the annular holding portion, the gasket is not pre-stressed.

13. The fixing element according to claim 12, wherein only the inner side wall of the annular holding portion holds the annular neck gasket axially from removal in a direction away from the annular end wall prior to securing the fixing element to the neck of the container.

14. The fixing element according to claim 13, wherein the inner side wall cooperates with only the inner side edge of the annular neck gasket to hold the annular neck gasket axially from removal in the direction away from the annular end wall prior to securing the fixing element to the neck of the container.

* * * * *